US006241514B1

(12) United States Patent
Joshi et al.

(10) Patent No.: US 6,241,514 B1
(45) Date of Patent: Jun. 5, 2001

(54) OXIDANT-DRIVEN DUST RECYCLING PROCESS AND DEVICE FOR ROTARY KILNS

(75) Inventors: Mahendra L. Joshi, Darien; Ovidiu Marin, Lisle; Olivier Charon, Chicago, all of IL (US); Jacques Dugue, Montigny le Bretonneux (FR)

(73) Assignees: L'Air Liquide, Societe Anonyme pour l'Etude et l'Exploitation des Procedes Georges Claude, Paris (FR); American Air Liquide, Inc., Walnut Creek, CA (US)

( * ) Notice: Subject to any disclaimer, the term of this patent is extended or adjusted under 35 U.S.C. 154(b) by 0 days.

(21) Appl. No.: 09/397,002

(22) Filed: Sep. 15, 1999

(51) Int. Cl.[7] ..... F27B 7/36

(52) U.S. Cl. ..... 432/105; 432/14; 432/117; 110/246

(58) Field of Search ..... 432/14, 15, 105, 432/106, 117; 110/246, 215, 216, 205, 206, 207, 208, 261, 262, 263, 264, 265

(56) References Cited

U.S. PATENT DOCUMENTS

| | | | | |
|---|---|---|---|---|
| 3,397,256 | | 8/1968 | Paul et al. . | |
| 3,875,357 | * | 4/1975 | Foster et al. | 110/219 |
| 4,354,829 | | 10/1982 | Estes . | |
| 4,566,393 | * | 1/1986 | Connell et al. | 110/262 |
| 4,741,694 | | 5/1988 | Mason et al. . | |
| 5,007,823 | | 4/1991 | Mayotte et al. . | |
| 5,116,399 | * | 5/1992 | Lauwers | 65/135 |
| 5,363,779 | * | 11/1994 | Bury | 110/236 |
| 5,572,938 | | 11/1996 | Leger . | |
| 5,580,237 | | 12/1996 | Leger . | |

OTHER PUBLICATIONS

Gaydas, R.A., "Oxygen enrichment of combustion air in rotary kilns", *Journal of the PCA R & D Laboratories*, 49–55 (Sep. 1965).

Wrampe, P. and Rolseth, H.C., "The effect of oxygen upon the rotary kiln's production and fuel efficiency: theory and practice", *IEEE Trans. Ind. Appl.*, 568–573 (Nov. 1976).

* cited by examiner

*Primary Examiner*—Denise L. Ferensic
*Assistant Examiner*—Jiping Lu
(74) *Attorney, Agent, or Firm*—Burns, Doane, Swecker & Mathis, L.L.P.

(57) ABSTRACT

A kiln adapted to recycle kiln dust includes a recycle dust pipe in fluid communication with an oxidant stream to increase the concentration of oxygen in the fluidized recycle dust before the recycle dust stream is directed into the kiln flame. Increasing the oxygen concentration in the recycle dust stream improves the efficiency of the recycling process. A supplemental fuel stream may be introduced into the recycle dust stream to provide an additional flame to preheat the recycle dust stream before the recycle dust stream is directed into the kiln flame.

11 Claims, 5 Drawing Sheets

OXIDANT-DRIVEN DUST RECYCLING PROCESS AND DEVICE FOR ROTARY KILNS

BACKGROUND

1. Field of Invention

The present invention relates to insufflation of recycle dust in a kiln. More particularly, the present invention relates to novel apparatus and processes for the injection of an oxidant into a fluidized recycle dust stream to improve calcination of recycle dust in a rotary kiln used for the calcination of minerals such as cement, lime, dolomite, magnesia, titanium dioxide, and other calcined materials.

2. Brief Description of Related Art

Cement may be manufactured by mixing and reacting raw materials such as calcium carbonate, silica, alumina, iron oxide, magnesium carbonate, etc. in a high temperature rotary kiln. A composition including the above material first undergoes a drying and heating process. Next, the material undergoes a calcination process, in which carbonate minerals are converted into mineral oxides. The above minerals are then recombined at much higher temperatures to produce a product comprising calcium silicates and calcium aluminates. The resulting product, referred to as clinker, is then cooled, pulverized, and mixed with additional ingredients to form cement.

FIG. 1 is a schematic, cross-sectional illustration of an exemplary rotary kiln. Referring to FIG. 1, rotary kiln 100 includes an inclined, rotatable clinker bed 110 having an inlet 112 for receiving raw clinker material 114 and an outlet 116 for releasing clinker material 114. Burner 118 provides a flame that extends into the interior of kiln 100 to define a combustion zone necessary to increase the temperature of the raw clinker material 114 that moves through kiln 100, and to enable the various chemical reactions that transform the raw material into clinker 114. It will be noted that in some modern cement plants, a significant amount of heat energy may be provided to the raw material prior to its arrival in kiln 100. In operation, clinker raw material 114 is fed into inlet 112 and flows along rotatable clinker bed 110, where it is subjected to heat from burner 118.

Depending on the raw product quality, kilns can be designed for wet, semi-wet, semi-dry and dry processes. The specific process determines the kiln dimensions. Each of these processes commonly uses an inclined rotary kiln. Raw materials are fed to the kiln at the elevated end and flow in a direction opposite the flow of combustion products originating from the main burner. The combustion of fuel and oxidant in burner 118 provides the required heat for the efficient processing of the material.

In many cases, particularly in long dry kilns, the calcining process results in a substantial amount of dust entrained in flue gases 120. The dust entrained in the flue gas system comprises completely and partially processed product, unburned carbon from fuel, various condensates and used refractory wall lining from the kiln. The dust, collected by the bag-house or cyclone separators, can be as much as 20% of the total raw material fed to the kiln. Under the government land reclamation laws and the Resource Conservation and Recovery Act (RCRA), the cement dust is considered a hazardous substance and the land disposal costs can be significant. Accordingly, it is both environmentally and economically desirable to recycle as much of this dust as possible.

FIG. 2 is a schematic illustration of a conventional dust recycling system 200. Kiln 204 emits flue gas dust from flue

208. Flue gas dust is collected from the bag-house 210 and/or cyclone type separator(s) 212. The flue gas dust is stored in a dust collection vessel 216, also referred to as a storage bin. In most cases, dense-phase conveying of flue gas dust is performed in a repetitive batch operation. The recycled flue gas dust enters an air-lock vessel commonly referred to as a transmitter 220 at atmospheric pressure. At a desired time (e.g., when the transmitter is full) the transmitter's inlet valve is closed and air compressor 224 provides a compressed air supply to increase the air pressure in transmitter 220, typically to a pressure between 80 and 100 pounds per square inch gauge (psig) (5.5 to 6.9 Bar). The air flow through transmitter 220 fluidizes recycled dust, which then flows under pressure in recycle dust pipe 228 back to rotary kiln 204. At a desired time (e.g., when transmitter 220 is empty), the air pressure at transmitter 220 may be lowered to atmospheric pressure and the cycle may be repeated. It will be appreciated that multiple transmitters could be used to provide a continuous operation.

The dense-phase conveying system depicted in FIG. 2 can achieve a high throughput over a long distance using a recycle dust pipe 228 having a relatively small diameter (e.g., 8 inches (0.2 m) to 10 inches (0.25 m)). A conventional measuring device 218 may be used to measure the mass of recycled dust conveyed to the kiln. A conventional controlled air management system 226 with pressure switches may be used to pressurize/depressurize each transmitter 220. Line boosters 232 may be used to provide additional air pressure at regular intervals along recycle pipe 228, if necessary, to reduce plugging of dense-phase recycle dust pipe 228. It will be appreciated that the amount of air required for transporting recycled dust depends upon parameters including the average dust particle size, the diameter and length of dust recycle pipe 228, and the desired flow rate. It will also be appreciated that the recycle dust pipe can be installed within the burner pipe.

Previous dust recycling efforts include a technique known as insufflation. Insufflation recycles flue gas dust using a dust injection pipe to feed recycle dust to the kiln's main burner. Conventional insufflation systems have the capability to recycle only a relatively small proportion of the total dust generated by the kiln, primarily because the recycle dust inhibits the main burner flame, thereby reducing the efficiency of the kiln. Among the undesirable effects of dust laden flame are a longer flame, high CO emissions, increased fuel consumption, incomplete clinker formation and lower yield.

Referring again to FIG. 1, kiln 100 includes a recycle dust pipe 140 disposed adjacent burner 118 for feeding recycle dust to burner 118. Dust pipe 140 is commonly disposed above burner 118 such that recycle dust exiting dust pipe 140 flows under the force of gravity into the flame of burner 118. Techniques exist to increase the amount of dust that can be recycled by a kiln. One technique is to provide an oxygen lance 130 underneath the main burner as described in U.S. Pat. No. 5,007,823 and U.S. Pat. No. 5,572,938. Oxygen lance 130 increases the amount of oxygen available to the burner. In addition, oxygen may be added through the existing air-fuel burner using an oxygen pipe 132 as shown in U.S. Pat. No. 5,572,938. In each of these configurations, oxygen is provided to the main flame to increase the main flame reaction rate.

Each of these insufflation techniques suffers from some drawbacks. First, their efficiency is limited. U.S. Pat. No. 5,007,823 claims that the insufflation techniques disclosed therein achieve, at most, a 65–75% increase in the amount of dust that can be recycled, when compared to a kiln in which no oxygen is added. Second, the use of a separate dust injection pipe leads to localized flame quenching at the dust injection location due to the heating of the dust by the main flame. This causes the flame to become relatively colder and less stable, particularly at high dust injection rates. Third, the oxygen injection rate and the dust recycle rate should be balanced to maintain a desired kiln temperature profile and product quality. Increasing the oxygen injection rate may cause localized overheating of the product and the furnace refractory. Conversely, increasing the recycle dust injection rate may cause localized quenching or cooling of the flame, flame instability, longer flame, higher CO emissions, increase in the cold end kiln temperature and incomplete clinker formation. Maintaining a desired relationship between the dust injection rate and the oxygen injection rate to effectively balance these effects is difficult.

Accordingly, there is a need in the art for improved systems and methods for recycling flue gas dust from kilns.

SUMMARY

The present invention provides a recycled dust injection system driven by an oxidant. The rate of dust injection can be varied according to a desired relationship with the oxygen flow rate. Directly coupling the oxygen flow rate and amount of recycled dust allows kiln operators to adjust the overall dust flow rate to reduce undesirable effects such as a dust laden longer flame, high CO emissions, increase in cold end kiln temperature, incomplete clinker formation and lower yield. The loss in weight feeder used for dust feeding may be electronically connected to the oxygen flow control valve so a predetermined ratio between oxygen flow rate and dust mass flow can be maintained in the dust injection system.

In one aspect the present invention provides an apparatus for recycling dust in a kiln useful for producing clinkers. The apparatus comprises a kiln chamber having an inlet and a outlet, a first burner positioned so that its flame is directed into said kiln chamber, a recycle dust source for providing a fluidized recycled dust stream, and an oxidant source in fluid communication with the recycle dust source for providing a fluidized recycled dust stream.

In another aspect, the invention provides a process for recycling dust in a kiln useful for producing clinkers that comprises a first burner positioned so that a flame is directed into a chamber of the kiln. The process comprises the steps of flowing a fluidized recycle dust stream to the first burner, and injecting an oxidant stream into the fluidized recycle dust stream.

DETAILED DESCRIPTION

Figure 1:
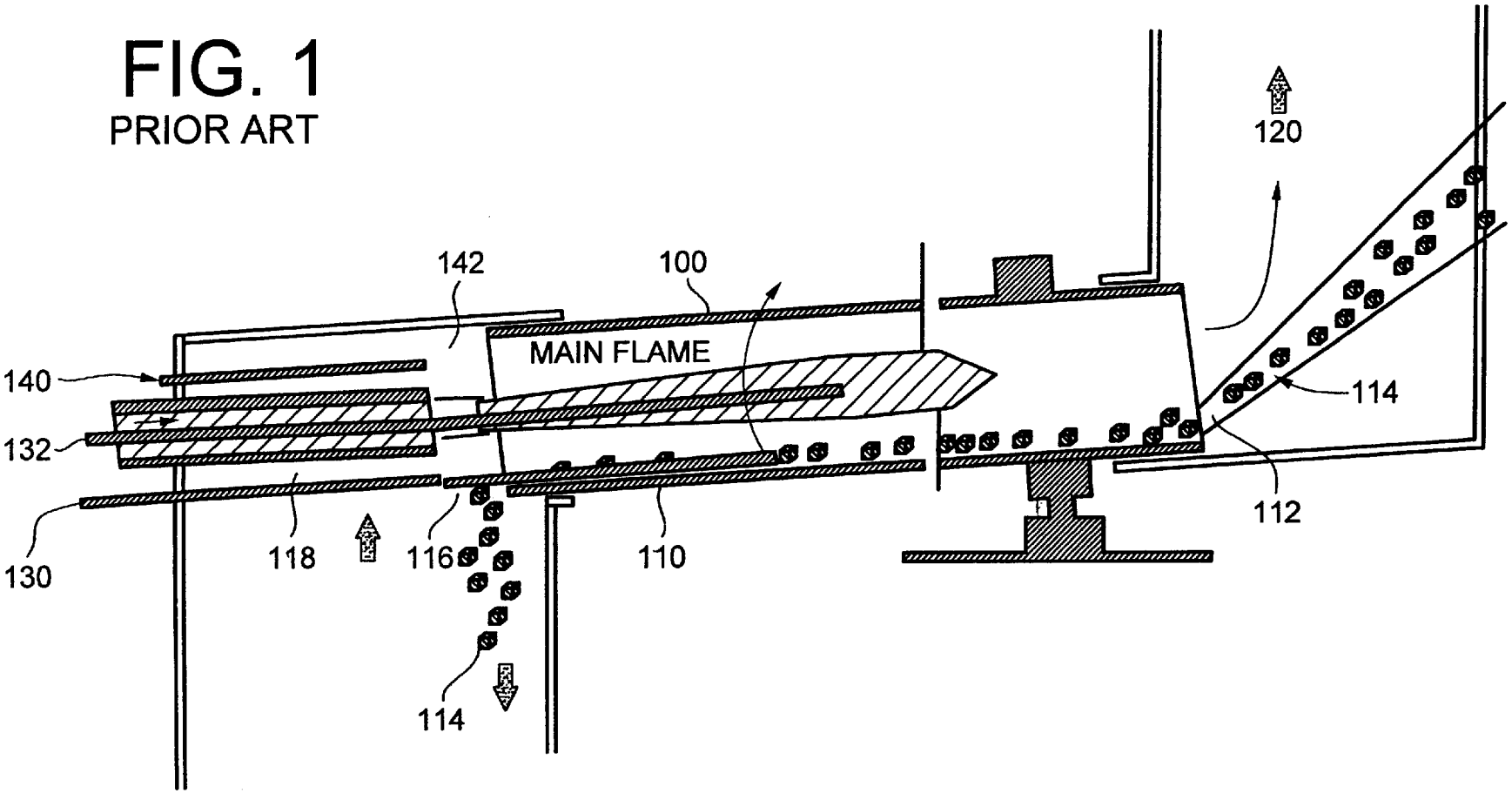
FIG. 1 PRIOR ART
FIG. 1 is a schematic, cross-sectional illustration of an exemplary rotary kiln.

In one aspect, the present invention provides an improved dust recycling system that uses an oxidant to deliver recycle dust to a heat source. The term "oxidant", according to the present invention, means a gas with an oxygen molar concentration of at least 50%. Such oxidants include oxygen-enriched air containing at least 50% vol., oxygen such as "industrially" pure oxygen (99.5%) produced by a cryogenic air separation plant or non-pure oxygen produced by e.g. a vacuum swing adsorption process (about 88% vol. $O_2$ or more) or "impure" oxygen produced from air or any other source by filtration, adsorption, absorption, membrane separation, or the like, at either room temperature (about 25° C.) or in preheated form. Preferably, the oxidant is introduced at a relatively high pressure (e.g., between about 20 psig (1.4 Bar) and 100 psig (6.9 Bar), and more preferably between about 80 psig (5.5 Bar) and 100 psig (6.9 Bar)) near the terminal end of a recycle dust pipe in a kiln. By way of example, in the kiln depicted in FIG. 1, an oxidant may be introduced into recycle dust pipe 140 at a position relatively near its terminal end 142.

A dust recycling system and process according to the invention includes an oxidant supply and control system for providing an oxidant flow rate of between 2000 standard cubic feet per hour (scfh) (0.0146 $Nm^3$/sec) to 200,000 scfh (1.46 $Nm^3$/sec). The oxidant supply system may be of conventional design and may include a standard train including a flow strainer, double block and double bleed type safety valves, low and high pressure switches, flow metering, automatic flow control valve(s) connected to a programmable logic controller (PLC) or personal computer (PC), pressure and flow indicators and check valves for unidirectional flow. The system further includes an oxidant driven dust injection system, multiple embodiments of which are discussed in detail below. Additionally, the system may include a control system for establishing a predetermined ratio of recycled dust mass to the oxygen flow rate.

Figure 2:
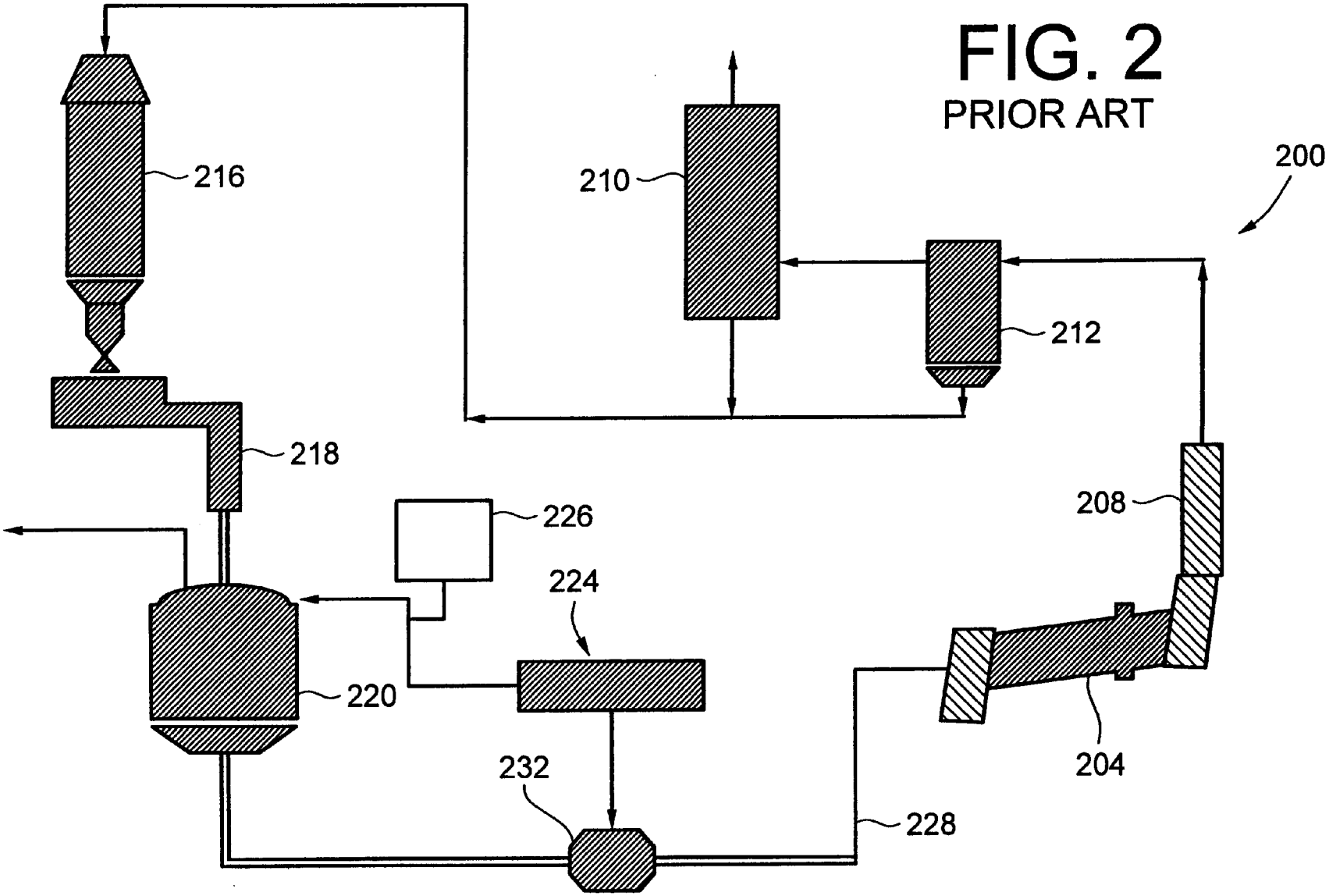
FIG. 2 PRIOR ART
FIG. 2 is a schematic illustration of an exemplary prior dust recycling system for use with a rotary kiln.
Figure 3:
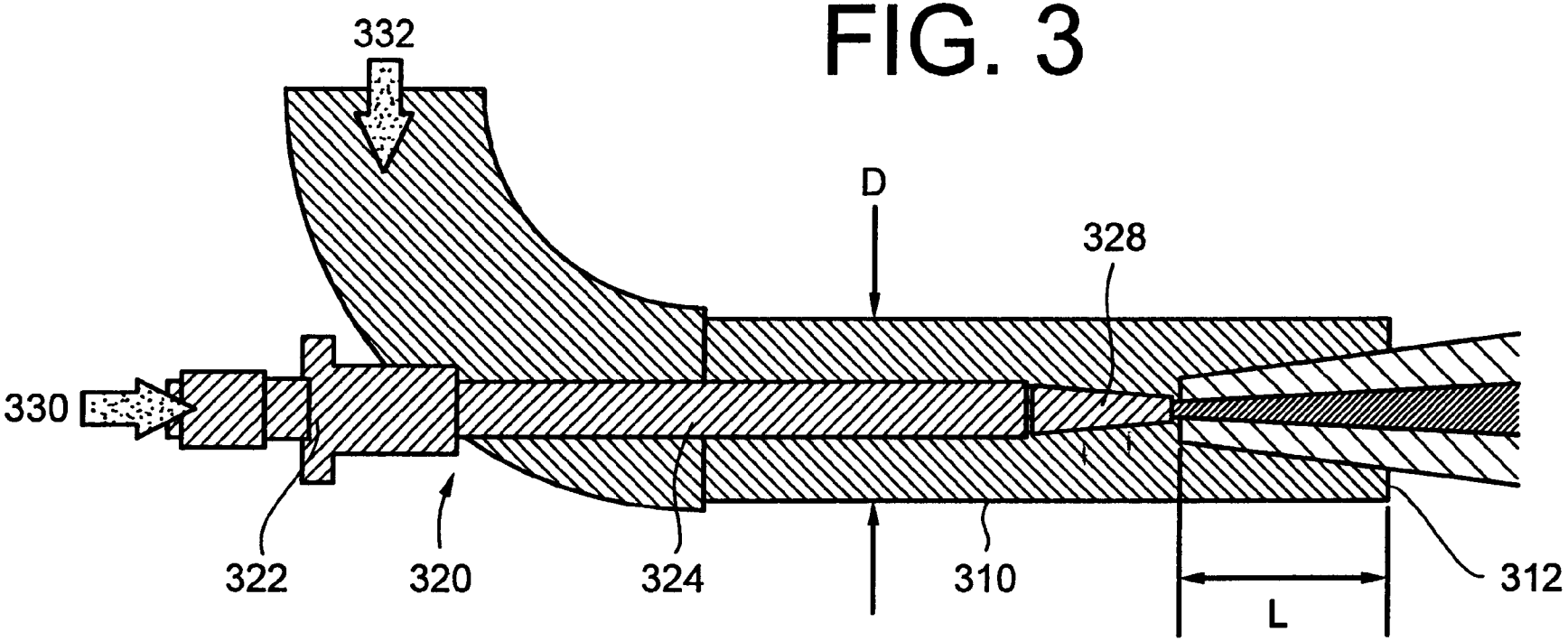
FIG. 3 is a schematic, cross-sectional view, taken along a longitudinal axis, of an oxidant-driven recycle dust injection system in accordance with a first embodiment of the present invention.

FIG. 3 is a schematic, cross-sectional illustration of an oxidant-driven recycle dust injection system in accordance with a first embodiment of the present invention. Referring to FIG. 3, there is illustrated a segment of recycle dust pipe 310 for transporting fluidized recycle dust to the burner of a kiln, such as kiln 100 in FIG. 1. Recycle dust pipe 310 may correspond to recycle dust pipe 228 in a dense-phase conveying system for recycle dust depicted in FIG. 2. Recycle dust pipe 310 may be made from any suitable metal or metal alloy and has a diameter (D) that preferably measures between about 1 inches (2.5 cm) and about 12 inches (30.5 cm), and more preferably between about 2 inches (5.1 cm) and about 6 inches (15.2 cm).

Recycle dust pipe 310 transports recycle dust fluidized with air, typically under elevated pressures measuring between 80 psig (5.5 Bar) and 100 psig (6.9 Bar), to a terminal downstream end 312 disposed proximate a heat source. Referring to FIG. 1, terminal end 312 may be disposed above kiln burner 118 such that recycle dust flows to burner 118 under the force of gravity. In accordance with the present invention, an oxidant injection system 320 is installed within dust pipe 310. Oxidant injection system 320 comprises an oxidant source (not shown) for providing oxidant flow, indicated by arrow 330, an oxidant pipe 324, and nozzle 328 attached to the discharge end of oxidant pipe 324. Oxidant injection system 320 also preferably includes a check valve 322 to prevent back flow through oxidant injection system 320.

Check valve 322, oxidant pipe 324, and nozzle 328 may be made from commercially available alloy steel. Nozzle 328 is removably attached to oxidant pipe 324 using conventional attachment mechanisms (e.g., machine threading) such that the nozzle may be replaced or adjusted to vary the oxidant velocity depending upon parameters including the recycle dust flow rate and kiln size. Oxidant pipe 324 must be dimensioned to fit within recycle dust pipe 310 and preferably does not substantially interfere with the flow of recycle dust in recycle dust pipe 310. Preferably, the diameter of oxidant pipe measures between about 0.25 inches (0.63 cm) and about 3 inches (7.6 cm), and more preferably between about 0.5 inches (1.3 cm) and about 2 inches (5.1 cm). In preferred embodiments, the ratio of the volume flow rate of oxygen to dust may range from 1000 scf of oxygen per ton of dust (26 $Nm^3$/ton) to 20,000 scf of oxygen per ton of dust (520 $Nm^3$/ton), and more preferably from 5000 scf of oxygen per ton of dust (130 $Nm^3$/ton) and 12,000 scf of oxygen per ton (312 $Nm^3$/ton).

Oxidant injection system 320 provides a high velocity oxidant-driven recycle dust transport. The high velocity oxidant acts as a transport medium to carry the dust particles to the main flame core and to accelerate the combustion process. Oxygen in the oxidant is thoroughly mixed with recycled dust that exits the dust pipe and enters the main flame inside the kiln. The combustion of recycle dust with oxygen is possible due to carbon and other combustible materials present in the recycled dust. The increased concentration of oxygen surrounding the dust particles enables a faster heating and processing of the recycled dust without quenching the flame or causing the flame to become unstable, unduly long, or resulting in the production of excessive CO emissions.

To facilitate effective mixing of the oxidant and the recycle dust, the oxidant preferably is injected at a predetermined distance from the terminal end 312 of recycle dust pipe 310. For a given recycle dust pipe diameter D, a mixing length L is desired to provide a partial mixing of the fluidized recycled dust stream and oxidant stream 330 injected into dust pipe 310. Preferably, length L is selected to provide an L/D ratio that measures between 0.25 to 4.0. Mixing lengths (L) that result in an L/D ratio lower than 0.25 tend not to provide adequate mixing of oxidant stream 330 and recycle dust 332. Mixing lengths (L) that result in a L/D ratio higher than 4.0 may increase the oxygen concentration in oxygen pipe 324 to a level that causes combustion within the dust pipe, which can cause partial melting of the dust pipe. The combustion within the dust pipe may occur if the recycled dust is contaminated with fuel, carbon particles, etc.

In operation, recycle dust 332 flows through recycle dust pipe 310, typically fluidized by high pressure (e.g. 80 psig (5.5 Bar) to 100 psig (6.9 Bar)) air. An oxidant stream 330 from a suitable oxidant source is injected into the recycle dust stream through nozzle 328 in a preferred velocity range of 100 to 1,000 feet per second (30 to 300 m/sec). A suitable oxidant source preferably includes a storage vessel for storing and providing oxidant injection system 320 with oxidant under a pressure that preferably measures between 20 psig (1.4 Bar) and 150 psig (10.3 Bar), and more preferably between 50 psig (3.4 Bar) and 100 psig (6.9 Bar). Particular details of th e oxidant storage and compression system are not critical to the present invention. One of ordinary skill in the art is capable of providing a suitable oxidant storage and compression system for oxidant injection system 320.

Figure 4A:
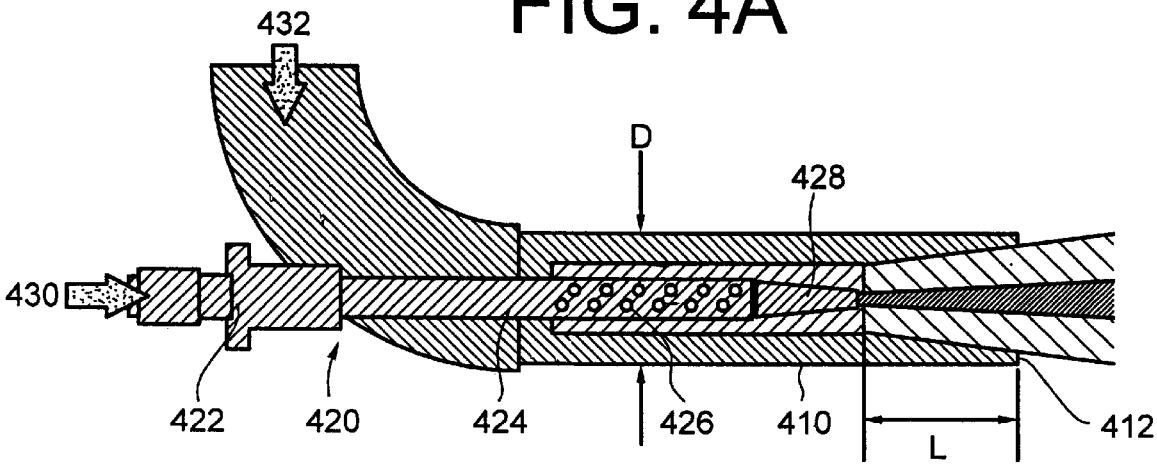
FIG. 4A is a schematic, cross-sectional view, taken along a longitudinal axis, of an oxidant-driven recycle dust injection system in accordance with a second embodiment of the present invention.
Figure 4B:
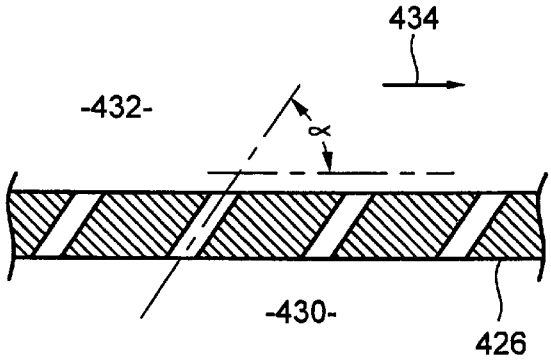
FIG. 4B is an enlarged, schematic, cross-sectional view, taken along a longitudinal axis, of the system depicted in FIG. 4A.

FIG. 4 is a schematic, cross-sectional view, taken along a longitudinal axis, of an oxidant-driven recycle dust injection system in accordance with a second embodiment of the present invention. The second embodiment , as shown in FIG. 4, employs an oxidant injection system that is substantially similar to the embodiment depicted in and described with reference to FIG. 3, but allows increased diffusion of oxygen within the recycled dust using a perforated or permeable oxygen pipe 424.

Referring to FIG. 4, recycle dust pipe 410 transports recycle dust fluidized with air, typically under elevated pressures measuring between 80 psig (5.5 Bar) and 100 psig (6.9 Bar), to a terminal end 412 disposed proximate a heat source. Referring to FIG. 1, terminal end 412 may be disposed above kiln burner 118 such that recycle dust flows to burner 118 under the force of gravity. In accordance with the present invention, an oxidant injection system 420 is installed within dust pipe 410. Oxidant injection system 420 comprises an oxidant source (not shown) for providing oxidant flow indicated by arrow 430, an oxidant pipe 424, and nozzle 428 attached to the discharge end of oxidant pipe 424. Oxidant pipe 424 includes a perforated, or oxidant-permeable, section 426 that allows a portion of the oxidant flowing, through to pass through the wall of the oxidant pipe and be transmitted from a radial surface of the oxidant pipe. Oxidant injection system 420 also preferably includes a check valve 422 to prevent back flow through the oxidant injection system.

The embodiment depicted in FIG. 4 provides a higher oxidant diffusion rate within recycle dust pipe 410, compared to the embodiment depicted in FIG. 3. An amount of oxidant measuring from just above 0% to just below 90% of the oxidant flow through oxidant pipe 424 may be transmitted into recycle dust stream 432 from the radial surface of perforated section 426. Increasing the oxidant released from perforated section 426 reduces the pressure in oxidant pipe 424, which reduces the velocity of oxidant expelled from nozzle 428. A lower oxidant velocity at nozzle 428 may be desired for certain applications, including smaller length kiln applications, low recycled dust injection rates, or for applications where it is critical to tightly control the overall flame temperature within the kiln.

It is desirable to maintain a steady flow of fluid oxidant in oxidant injection system 420 to prevent the surrounding dust stream from plugging perforated section 426 of oxidant pipe 424. If the oxidant source is shut off, it may be desirable to provide a compressed air source to continue a fluid flow through oxidant injection system 424, or to periodically purge the perforated section 426 of oxidant injection pipe 424. The L/D ratio may be maintained in a range of 0.25 to 4.0, as discussed in connection with FIG. 3. In addition, it will be appreciated that the perforated holes in the radial surface of oxidant pipe may be oriented to cause the oxidant to flow from perforated section 426 at an angle, $\alpha$, that measures between 10° to 90°, relative to the to the dust stream flow direction 434 (see FIG. 4*a*).

Figure 5:
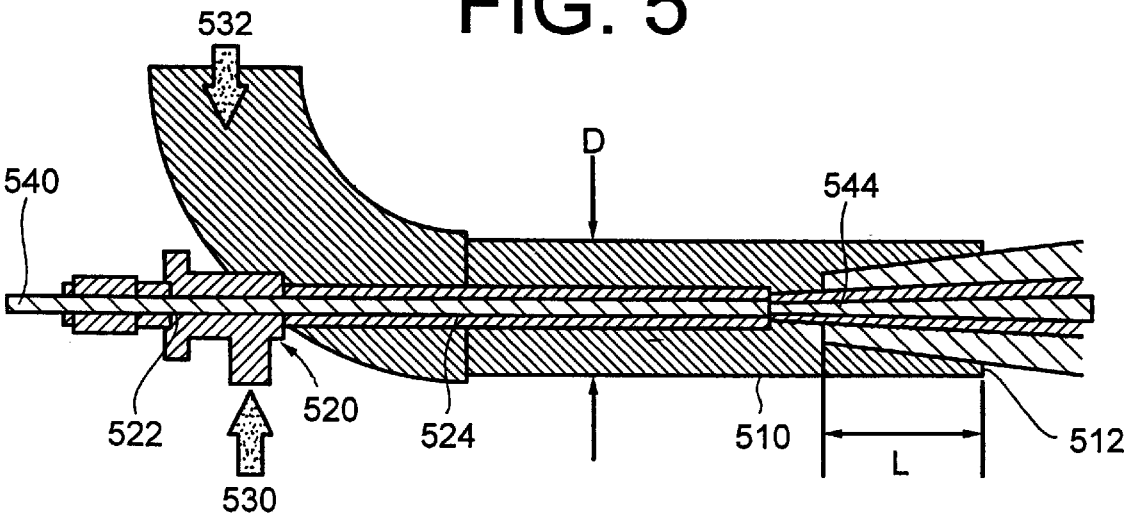
FIG. 5 is a schematic, cross-sectional view, taken along a longitudinal axis, of an oxidant-driven recycle dust injection system in accordance with a third embodiment of the present invention.

FIG. 5 is a schematic, cross-sectional view, taken along a longitudinal axis, of an oxidant-driven recycle dust injection system in accordance with a third embodiment of the present invention. The embodiment depicted in FIG. 5 employs an oxidant injection system that is substantially similar to the embodiments depicted in FIG. 3 and FIG. 4, but includes a fuel line 540 in fluid communication with oxidant pipe 524 for providing a flame source within recycle dust pipe 510.

Referring to FIG. 5, recycle dust pipe 510 transports recycle dust fluidized with air, typically under elevated pressures measuring between 80 psig (5.5 Bar) and 100 psig (6.9 Bar), to a terminal end 512 disposed proximate a heat source. Referring to FIG. 1, terminal end 512 may be disposed above kiln burner 118 such that recycle dust flows to burner 118 under the force of gravity. In accordance with the present invention, an oxidant injection system 520 is disposed within dust pipe 510. Oxidant injection system 520 comprises an oxidant source (not shown) for providing oxidant flow indicated by arrow 530, and an oxidant pipe 524. Oxidant injection system 520 also preferably includes a check valve 522 to prevent back flow through oxidant injection system. A fuel pipe 540 disposed within oxidant pipe 524 is connected to a suitable fuel source (not shown) for providing fuel to oxidant injection system to produce a flame 544 in recycle dust pipe 510.

Figure 6:
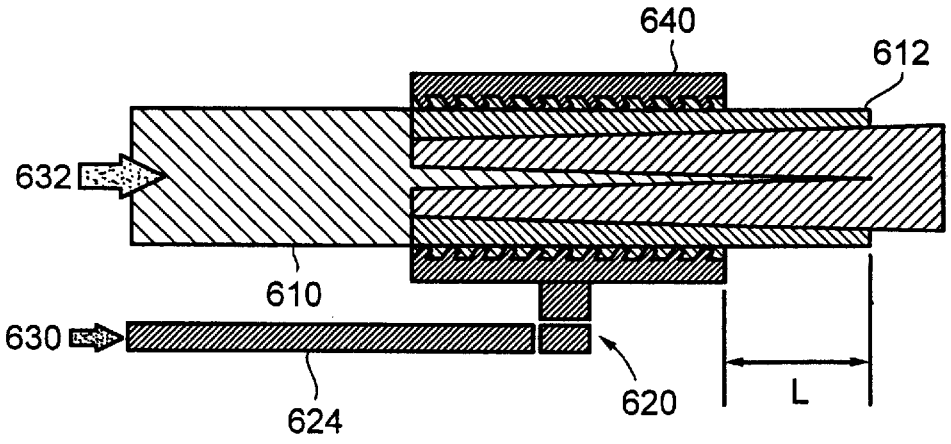
FIG. 6 is a schematic, cross-sectional view, taken along a longitudinal axis, of an oxidant-driven recycle dust injection system in accordance with a fourth embodiment of the present invention.

In the embodiment depicted in FIG. 5, fuel (preferably natural gas) may be used to improve recycled dust stream injection into the main flame of the kiln. The substoichiometric combustion of fuel and oxidant in flame 544 provides a propulsive effect to the recycle dust stream 532. The combustion of fuel and oxidant in flame 544 raises the average temperature of recycle dust stream 532 and also entrains recycle dust stream 532 in the flame core. The resulting hot dust stream 532 is transported for mixing with the main flame. This process is thermally efficient since the dust stream is partially heated (by as much as 1,000° F. (550° C.)) in flame 544 before injection into the kiln's main flame. In addition, the preheated dust and oxidant a allows better control of the overall mixing process. The fuel and oxidant flow velocities preferably range from 100 feet/sec (30 m/sec) to 1,000 feet/sec (300 of/sec). As described in connection with the embodiments depicted in FIG. 3 and FIG. 4, an LID ratio of 0.25 to 4 may be used for effective preheating of dust and hot oxygen injection into the main flame. The overall stoichiometric ratio (oxygen to fuel ratio) can be anywhere from theoretically correct (e.g., 2.00) to oxygen rich (e.g., 12.00). A fuel-rich combustion (e.g., a stoichiometric ratio of 0.1 to 2.00) can be used if oxygen injection is not required due to the high product temperature or a kiln refractory temperature limitation. FIG. 6 is a schematic, cross-sectional view, taken along a longitudinal axis, of an oxidant-driven recycle dust injection system in accordance with a fourth embodiment of the present invention. The embodiment depicted in FIG. 6 employs an oxidant injection system similar to the embodiments depicted in FIG. 3 and FIG. 4, except that oxidant pipe 624 is disposed adjacent recycle dust pipe 610 and connects to a baffle 640 for providing fluid communication between oxidant pipe 624 and recycle dust pipe 610.

Referring to FIG. 6, recycle dust pipe 610 transports recycle dust fluidized with air, typically under elevated pressures measuring between 80 psig (5.5 Bar) and 100 psig (6.9 Bar), to a terminal end 612 disposed proximate a heat source. Referring to FIG. 1, terminal end 612 may be disposed above kiln burner 118 such that recycle dust flows to burner 118 under the force of gravity. In accordance with the present invention, an oxidant injection system 620 comprises an oxidant source (not shown) for providing oxidant flow indicated by arrow 630, an oxidant pipe 624, and baffle 640 attached to the discharge end of oxidant pipe 624. Baffle 640 extends about the radial circumference of recycle dust pipe 610, however, it will be appreciated that baffle 640 need only be connected to a portion of recycle dust pipe 640. The segment of recycle dust pipe 610 connected to baffle 640 includes a perforated, or oxidant-permeable, section that allows a portion of oxidant to be transmitted across the radial surface of recycle dust pipe 610. Oxidant injection system 620 may optionally include a check valve (not shown) to prevent back flow through oxidant injection system.

In the embodiment depicted in FIG. 6, baffle 640 implements a radial-axial oxidant injection. Oxidant may be injected through multiple holes at an angle (e.g., between 10° to 90° to the direction of flow of recycle dust 632) and is mixed with the fluidized dust conveyed in the dust pipe. Advantageously, the embodiment depicted in FIG. 6 may be retrofitted onto an existing recycle dust pipe 610 that is generally straight and it is maintained straight after oxidant injection. The oxidant pressure required for this embodiment is relatively higher than the pressure required for the embodiments, illustrated in and described with reference to FIGS. 1–5, due to the pressure drop encountered through the dust bed penetration in recycle dust pipe 610. However, the mixing of oxidant with recycled dust is better.

While the invention has been described with reference to particular embodiments thereof, it will be apparent to one skilled in the art that various changes can be made, and equivalents employed, without departing from the scope of the invention. All of the aforementioned prior documents, including U.S. patents, are hereby incorporated by reference.

What is claimed is:

1. An apparatus for recycling dust in a kiln useful for producing clinkers, comprising:

a kiln chamber having an inlet and a outlet;

a first burner positioned so that its flame is directed into said kiln chamber;

a recycle dust source for providing a fluidized recycled dust stream into said kiln chamber and including a recycle dust feeder pipe having an outlet at a downstream end thereof, said recycle dust feeder pipe adapted to feed recycle dust to the first burner; and an oxidant source in fluid communication with the recycle dust source for providing a fluidized recycled dust and oxidant stream, wherein the oxidant source comprises an oxidant feeder pipe in fluid communication with the recycle dust feeder pipe at a point upstream of said recycle dust feeder pipe downstream end, and wherein the recycle dust feeder pipe has a diameter D, and fluid communication between the recycle dust feeder pipe and the oxidant feeder pipe is established at a distance L from an end of said recycle dust feeder pipe, the ratio of L/D being between 0.25 and 4.0.

2. An apparatus according to claim 1, wherein:

the oxidant feeder pipe extends through a portion of the recycle dust feeder pipe.

3. An apparatus according to claim 2, further comprising:

a fuel pipe in fluid communication with the oxidant feeder pipe.

4. An apparatus according to claim 1, wherein the oxidant feeder pipe comprises:

a nozzle connectable to an end of the oxidant feeder pipe.

5. An apparatus according to claim 1, wherein the oxidant feeder pipe comprises:

a diffusion section having at least one channel for releasing oxidant from a radial surface of the oxidant feeder pipe.

6. An apparatus according to claim 1, further comprising:

a manifold in fluid communication with the oxidant feeder pipe and the recycle dust feeder pipe.

7. An apparatus according to claim 1, wherein fluid communication between the oxidant source and the source for providing a fluidized recycled dust stream is established in the kiln.

8. An apparatus according to claim 1, wherein the oxidant source comprises:

an oxidant supply system for supplying an oxidant flow rate of at least 2000 scfm (0.0146 $Nm^3$/sec).

9. An apparatus according to claim 8, wherein the oxidant supply system provides an oxidant flow rate that measures between 2000 scfm (0.0146 $Nm^3$/sec) and 200,000 scfm (1.46 $Nm^3$/sec).

10. An apparatus according to claim 1, wherein the oxidant source for providing a fluidized recycled dust stream comprises:

means for measuring the mass of recycle dust fed to the first burner.

11. An apparatus according to claim 10, wherein the oxidant source comprises:

a control system for controlling the oxidant flow rate to obtain a desired ratio between the mass of recycle dust fed to the first burner and the oxidant flow rate.

* * * * *